United States Patent [19]

Fukuhara

[11] Patent Number: 4,512,164

[45] Date of Patent: Apr. 23, 1985

[54] PIVOTED LATCH NEEDLE

[75] Inventor: Masao Fukuhara, Nishimuro, Japan

[73] Assignee: Fukuhara Needle Company, Ltd., Wakayama, Japan

[21] Appl. No.: 535,217

[22] Filed: Sep. 23, 1983

[30] Foreign Application Priority Data

Oct. 4, 1982 [JP] Japan ..... 57-174841

[51] Int. Cl.[3] ..... D04B 35/04

[52] U.S. Cl. ..... 66/121

[58] Field of Search ..... 66/121, 122, 123; 163/3, 5

[56] References Cited

U.S. PATENT DOCUMENTS 3,786,654 1/1974 Sgrillo ..... 66/121

4,294,086 10/1981 Mayer et al. ..... 66/121

*Primary Examiner*—Wm. Carter Reynolds

*Attorney, Agent, or Firm*—Nathan Levin

[57] ABSTRACT

Fine gauge pivoted latch needles having a shank portion, a hook portion and a cheek portion adjacent to the hook portion, a first slot extending through the cheek portion and in which the latch is pivotally supported, a second slot extending through the shank portion in continuation of the first slot, the width of the second slot being less than the width of the first slot. The bottoms of the slots are curvalinear. The combined slots serving to make the extended side walls thereof resilient thereby to absorb the shocks and to dampen the vibrations to which the needles are subjected in use.

6 Claims, 9 Drawing Figures

PIVOTED LATCH NEEDLE

The present invention relates generally to the art of knitting and more particularly to fine gauge pivoted latch needles used in modern high speed multi-feed fine gauge circular knitting machines.

In the quest for ever increasing production on fine gauge multi-feed circular knitting machines, the number of feeds as well as the operating speeds of the machines are ever being increased. Such machine changes, however, place added stresses and srains upon the fine and finer gauge needles being used and have been a cuase of increased needle failures in such machines.

With the increased nunmbers of feeds the needle operating cams are steeper so that there is increased linear speed of the reciprocating needles and quicker directional changes thereof during the knitting process. Increased machine speeds have a similar and cumulative effect upon the needles with resultant harmful longitudinal vibrations therein. The needles are also subject to lateral vibrations induced by variations in yarn tensions which increase with the increase in knitting speeds. Further, with the increase in knitting speeds, the latches of the needles open and close more often with increasing force with consequent increase in the rate at which the latch spoon strikes against the latch seat in the side walls of the latch slot with the result that there is increased damage to the latch spoon, to the side walls of the cheeks of the needles and to the side walls of the latch slots.

An attempt to lessen the above set forth stresses and strains upon the needles to lessen the failure thereof in high speed knitting is shown in U.S. Pat. No. 4,294,086 to Mayer et al. In the Mayer patent the usual pivoted latch needle structure has been changed to make the latch slot both deeper and longer while retaining its width. The result of such change is beneficial in that it reduces the weight of the needles and makes the side walls of the latch slot more resilient thereby to absorb and to dampen the otherwise harmful vibrations and to reduce needle failure.

The object of the present invention is also to lessen needle failure when the needles are subjected to the above set forth stresses and strains. However, while the objectives of the Mayer needle structure and of the present applicant may be similar, each has provided a different solution to the problem. Applicant has provided a second latch slot of reduced width in extension of the usual latch slot to reduce the needle failures. A comparison of the Mayer and of applicant's needle structures will be made in the following specification.

With the above and other objects in view as will become apparent from the accompanying drawings and the description thereof, the invention resides in the improvement in pivoted latch needles for circular knitting machines as shown and as described and as set forth in the appended claims.

In the drawings:

FIGS. 1 through 4 are views of the prior art needle as related to the aforesaid Mayer patented needle and in which FIG. 1 is a top plan view of the Mayer needle;

FIG. 2 is a side view of FIG. 1 partially broken away;

Figure 1:
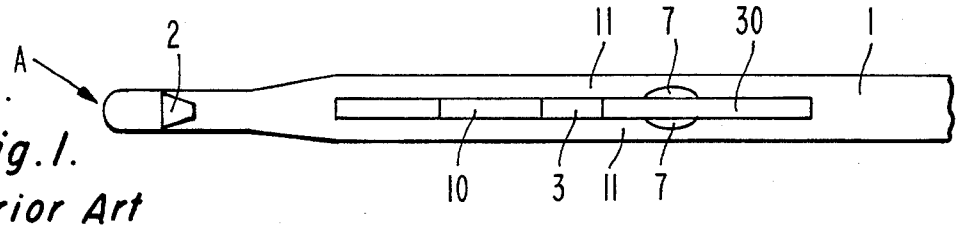
Fig. 1. Prior Art
Figure 2:
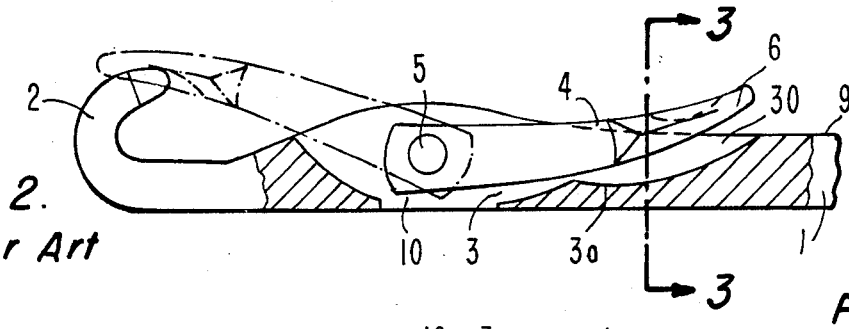
Fig. 2. Prior Art
Figure 3:
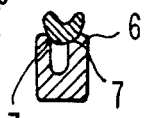
Fig. 3. Prior Art
Figure 4:
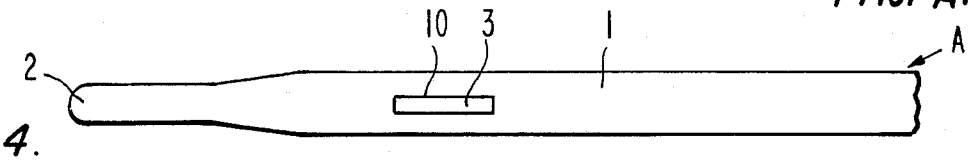
Fig. 4. Prior Art
Figure 5:
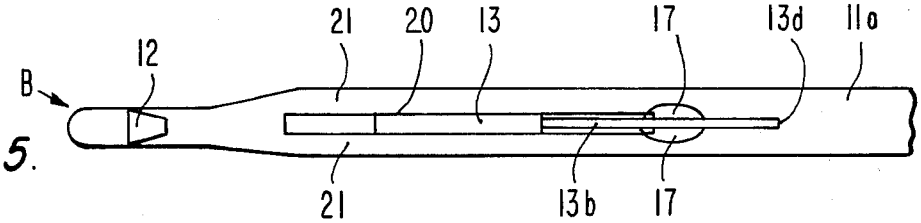
Figure 6:
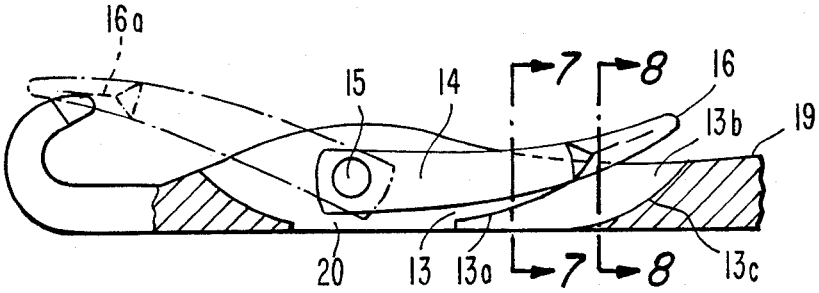
Figure 7:
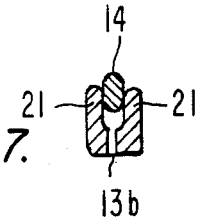
Figure 8:
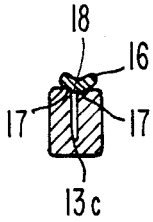
Figure 9:
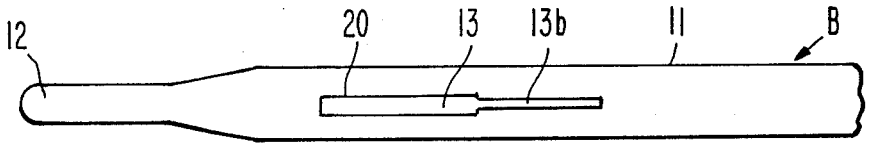

FIG. 3 is a cross-sectional view as taken on line 3—3 of FIG. 2; and FIG. 4 is a bottom plan view of FIG. 1, FIG. 5 is a top plan view of applicant's needle, FIG. 6 is a side view of FIG. 5 partially broken away, FIGS. 7 and 8 are cross-sectional views as taken on lines 7—7 and 8—8 of FIG. 6, and FIG. 9 is a bottom plan view of FIG. 5.

The reference numbers used in FIGS. 1 through 4 of the present drawings are the same as those used in the Mayer patent, and where additional numbers are used an appropriate letter has been added to the number in question.

In FIGS. 1 through 4, a latch needle A has an elongated shank 1 with an operating butt at one end thereof (not shown) and with a hook 2 at its other end. The needle has a widened cheek portion adjacent the hook and in which there is a slot 3 of conventional width in which a latch 4 is pivotally supported on pivot 5. Spoon end 6 of the latch in closed position covers hook 2 and in open position rests in cut-out seats 7, 7 formed in the upper near edges of the side walls 11, 11 of the slot. Latch slot 3 has a bottom opening 10 in the needle and the first section of the slot following the opening is curvalinear and is as short as possible. Then comes a rectalinear portion 3*a*, which, in turn, is adjoined by a further curvalinear section 30 of the slot. At section 3*a* the depth of the slot is greater than half the height of the needle shank. As pointed out in the Mayer patent, the sidewalls of the extended and deepened slot become relatively resilient and act to dampen and to absorb impact forces of the latch spoon against the cut-outs 7, 7. It is noted that making the first portion of the slot as short as possible results in a shorter than usual bottom slub clearance opening 10.

In FIGS. 5 through 9, a latch needle B has an elongated shank with an operating butt at one end thereof (not shown) and a hook 12 at its other end. The needle has a widened cheek portion adjacent the hook and in which there is a slot 13 of conventional width in which a latch 14 is pivotally supported on pivot 15. Latch slot 13 extends completely through the needle and terminates on the butt-side of the cheek portion along curvalinear line 13*a*. Adjoining slot 13 at 13*a* is a second or continuing slot 13*b* which also extends completely through the needle and terminates along curvalinear line 13*c*. Slot 13*b* is narrower than slot 13 with the width thereof being from 0.5 to 0.8 times the width of the first slot 13. If narrower than 0.5 times it is difficult to machine, and if greater than 0.8 times the strength of the side walls 21, 21 is affected. First slot 13 and second slot 13*b* are interconnected along line 13*a*. The length of the narrower slot may be made to extend beyond the tip of the opened latch.

Bottom opening 20 of slot 13 is longer than the corresponding opening 10 of slot 3 and it has an adjoining bottom opening of the slot 13*b*. The combined bottom openings of slots 13 and 13*b* provide for increased slub clearance in the needle.

Damage to both needle latch and needle shank is reduced as a result of adding the narrower slot in continuation of the usual slot of conventional needles for the reason that the cumulative effect of both slots is used to provide shock absorbing resilience to the needle.

I claim:

1. A pivoted latch needle for use in knitting machines, the needle having an elongated shank with a hook at one end thereof and with a cheek portion adjacent the hook, a first slot extending through the shank at the cheek portion thereof, a latch pivotally mounted in the first slot, and a second slot extending through the shank adjacent the first slot, the slots being connected with the width of the second slot being less than the width of the first slot.

2. A needle as in claim 1 wherein the width of the second slot is from 0.5 to 0.8 times the width of the first slot.

3. A needle as in claim 1 wherein at least one of the slots is provided with a curvalinear bottom.

4. A needle as in claim 1 wherein the slots extend through the needle shank to form a pair of connected bottom openings therein, the combined openings providing slub clearance for the needle.

5. A needle as in claim 4 wherein the width of one of the openings is less than the width of the other opening.

6. A needle as in claim 1 wherein the connected first and second slots together cause the side walls of the slots to be more resilient to dampen needle vibration and thereby to reduce needle failure.

* * * * *

Disclaimer and Dedication

4,512,164.—*Masao Fukuhara,* Nishimuro, Japan. PIVOTED LATCH NEEDLE. Patent dated Apr. 23, 1985. Disclaimer and Dedication filed Mar. 24, 1986, by the assignee, *Fukuhara Needle Co. Ltd.*

Hereby disclaims and dedicates to the Public all claims of said patent.

[*Official Gazette June 17, 1986.*]